United States Patent [19]

Yoshinaga et al.

[11] Patent Number: 4,535,735

[45] Date of Patent: Aug. 20, 1985

[54] MULTI-GAP SPARK IGNITION SYSTEM

[75] Inventors: Toru Yoshinaga, Okazaki; Toshihiko Igashira, Toyokawa; Hisasi Kawai, Toyohashi; Seiji Morino, Okazaki; Norihiko Nakamura, Mishima, all of Japan

[73] Assignees: Nippon Soken, Inc., Nishio; Toyota Jidosha Kabushiki Kaisha, Toyota, both of Japan

[21] Appl. No.: 376,132

[22] Filed: May 7, 1982

[30] Foreign Application Priority Data

May 9, 1981 [JP] Japan ..... 56-69761

[51] Int. Cl.[3] ..... F02P 15/08

[52] U.S. Cl. ..... 123/310; 123/169 MG

[58] Field of Search ..... 123/169 MG, 310, 143 B; 313/123, 141

[56] References Cited

U.S. PATENT DOCUMENTS

| | | | |
|---|---|---|---|
| 1,476,252 | 12/1923 | Hempel | 123/169 MG |
| 1,506,823 | 9/1924 | Francoeur | 313/123 |
| 1,509,471 | 9/1924 | Burhans | 313/123 |
| 2,904,610 | 9/1959 | Morrison | 123/169 MG |
| 3,567,987 | 3/1971 | Schnurmacher | 123/169 MG |

*Primary Examiner*—Andrew M. Dolinar

*Attorney, Agent, or Firm*—Cushman, Darby & Cushman

[57] ABSTRACT

A multi-gap spark ignition system is disclosed. The system comprises a plurality of spark gaps which are formed in series. The length of the spark gaps increases from the high voltage power source side towards the earth side. According to the present invention, necessary voltage to be applied to the spark ignition system can be decreased.

1 Claim, 5 Drawing Figures

MULTI-GAP SPARK IGNITION SYSTEM

BACKGROUND OF THE INVENTION

The present invention relates to a multi-gap spark ignition system to be installed in a spark-ignition engine.

Recently, lean-burn systems, exhaust gas recirculation systems or the like have been adopted in order to reduce harmful components in the exhaust gases of an automobile and in order to prevent the waste of resources.

However, according to these systems, the ignitability and the combustion speed are lower.

Conventionally, the ignitability and the combustion speed have been improved by providing a plurality of ignitors.

However, in this case, the number of high voltage power sources also increases.

In order to decrease the number of the high voltage power sources, a system wherein a plurality of spark gaps having a constant width are formed in series has been proposed.

However, as the number of the spark gasp increases, necessary voltage to be applied thereto increases.

Accordingly, one object of the present invention is to provide a multi-gap spark ignition system which is effective for improving the ignitability of an engine.

Another object of the present invention is to provide a multi-gap spark ignition system of which the necessary voltage can be reduced as compared with the conventional system of the same type.

DESCRIPTION OF THE DRAWINGS

Other objects and advantages of the invention will become apparent from the following description of embodiments thereof with reference to the accompanying drawings wherein:

FIGS. 3 to 5 are graphs showing the experimental results of the relation between the necessary voltage of the spark ignition systems and the inner pressure of the cylinder.

SUMMARY OF THE INVENTION

In the multi-gap spark ignition system according to the present invention, a plurality of spark gaps are formed in series so that the length of the spark gaps increases from the high voltage power source side towards the earth side. According to the present invention, the necessary voltage to be applied to the spark ignition system can be decreased as compared with the conventional system of which each spark gap has a constant length substantially equal to the average length of the spark gaps of the present invention.

DETAILED DESCRIPTION OF THE INVENTION

Hereinafter, the present invention will be explained in detail in accordance with embodiments and experiments thereof.

Figure 1:
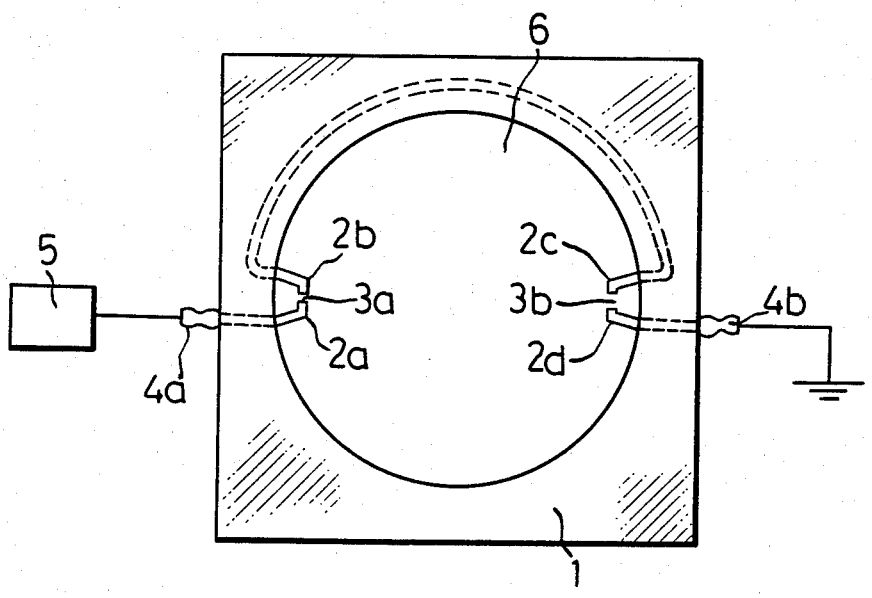
FIG. 1 is a plan view of a first embodiment of the multi-gap spark ignition system according to the present invention.

FIG. 1 illustrates a first embodiment of the multi-gap spark ignition system according to the present invention.

In FIG. 1, an insulating plate 1 formed of alumina ceramics having a thickness of about 6 mm is interposed between a cylinder head (not shown) and a cylinder block (not shown) of an internal combustion engine of an automobile through gaskets (not shown). The insulating plate 1 is provided with a central hole which defines one portion of the combustion chamber 6 of the engine.

A high voltage electrode 2*a*, intermediate electrodes 2*b*, 2*c* and an earth electrode 2*d*, are formed of nickel alloy so as to have a diameter of 2.5 mm and are buried within the insulating plate 1.

One end of each of the electrodes 2*a*, 2*b* projects from the insulating plate 1 into the combustion chamber 6 so as to be opposed to each other. Between the projecting ends of the electrodes 2*a*, 2*b*, a spark gap 3*a* is formed. One end of each of the electrodes 2*c*, 2*d* also projects into the combustion chamber 6 so as to be opposed to each other. Between the projecting ends of the electrodes 2*c*, 2*d*, a spark gap 3*b* is formed in symmetry with the spark gap 3*a* in the radial direction of the central hole of the insulating plate 1. The projecting end of each of the electrodes 2*a*, 2*b*, 2*c* and 2*d* preferably is in the shape of the letter L.

The other end of the electrode 2*a* is connected to a secondary ignition coil 5 through a terminal 4*a*. The other end of the electrode 2*d* is connected to a terminal 4*b* which is earthed.

The electrodes 2*b*, 2*c* are integrally connected to each other within the insulating plate 1.

The length of the spark gap 3*b* on the earth side is made larger than that of the spark gap 3*a* on the high voltage power source side.

For example, the length of the spark gap 3*a* is 0.3 mm and the length of the spark gap 3*b* is 0.5 mm.

When high voltage is applied between the terminals 4*a* 4*b* by means of the ignition coil 5, breakdown firstly occurs in the spark gap 3*a* having a length of 0.3 mm so that an electric current flows therethrough. As a result, potential difference between the electrodes 2*a*, 2*b* disappears.

Then, through the spark gap 3*b* having a length of 0.5 mm, breakdown occurs.

Figure 2:
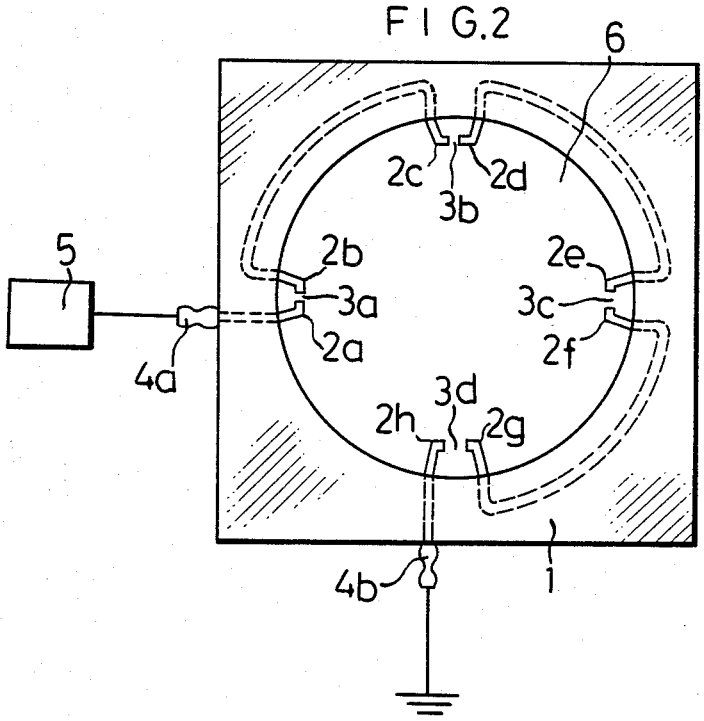
FIG. 2 is a plan view of a second embodiment of the multi-gap spark ignition system according to the present invention.

FIG. 2 illustrates a second embodiment of the multi-gap spark ignition system.

In the second embodiment, four spark gaps are formed in series at regular intervals.

In FIG. 2, the reference numeral 2*a* designates a high voltage electrode, 2*b*, 2*c*, 2*d*, 2*e*, 2*f*, 2*g*, designate intermediate electrodes and 2*h* designates an earth electrode and the reference numerals 3*a*, 3*b*, 3*c*, 3*d* designate spark gaps.

For example, the length of the spark gap 3*a* is 0.25 mm, the length of the spark gap 3*b* is 0.35 mm, the length of the spark gap 3*b* is 0.45 mm and the length of the spark gap 3*d* is 0.55 mm.

The average length of the spark gaps 3*a*, 3*b*, 3*c*, 3*d* is 0.4 mm.

According to the second embodiment, necessary voltage to be applied to the spark ignition system can be made small as compared with the conventional spark ignition system provided with four spark gaps having an equal length of 0.4 mm.

Hereinafter, the results; of the experiments made by the inventors will be explained.

Figure 3:
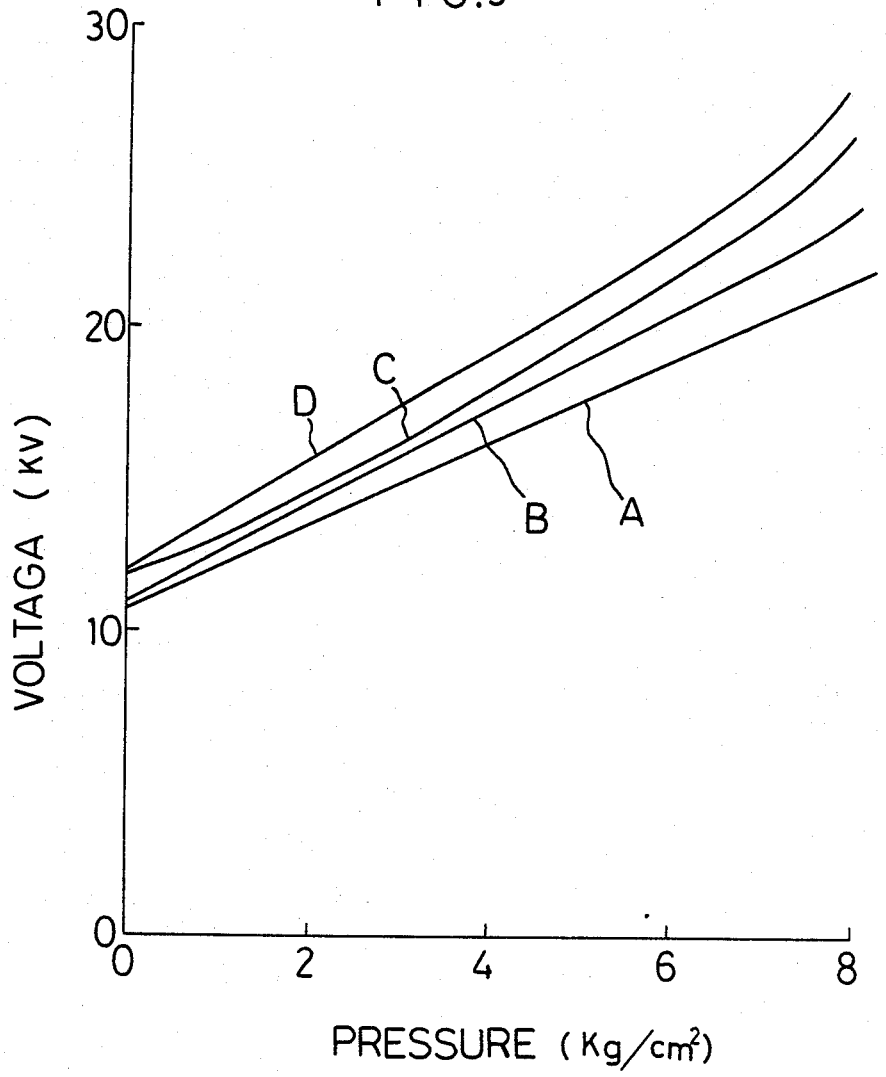

FIG. 3 shows the relation between the inner pressure of the cylinder and the necessary voltage to be applied to the ignition systems provided with the different number of spark gaps.

The length of all spark gaps is 0.4 mm.

In FIG. 3, the lines A, B, C, D show the results of the spark ignition systems provided with one, two, three, and four spark gaps, respectively.

As is apparent from the experimental result, as the number of spark gaps increases, necessary voltage to be applied to the spark ignition system increases.

Figure 4:
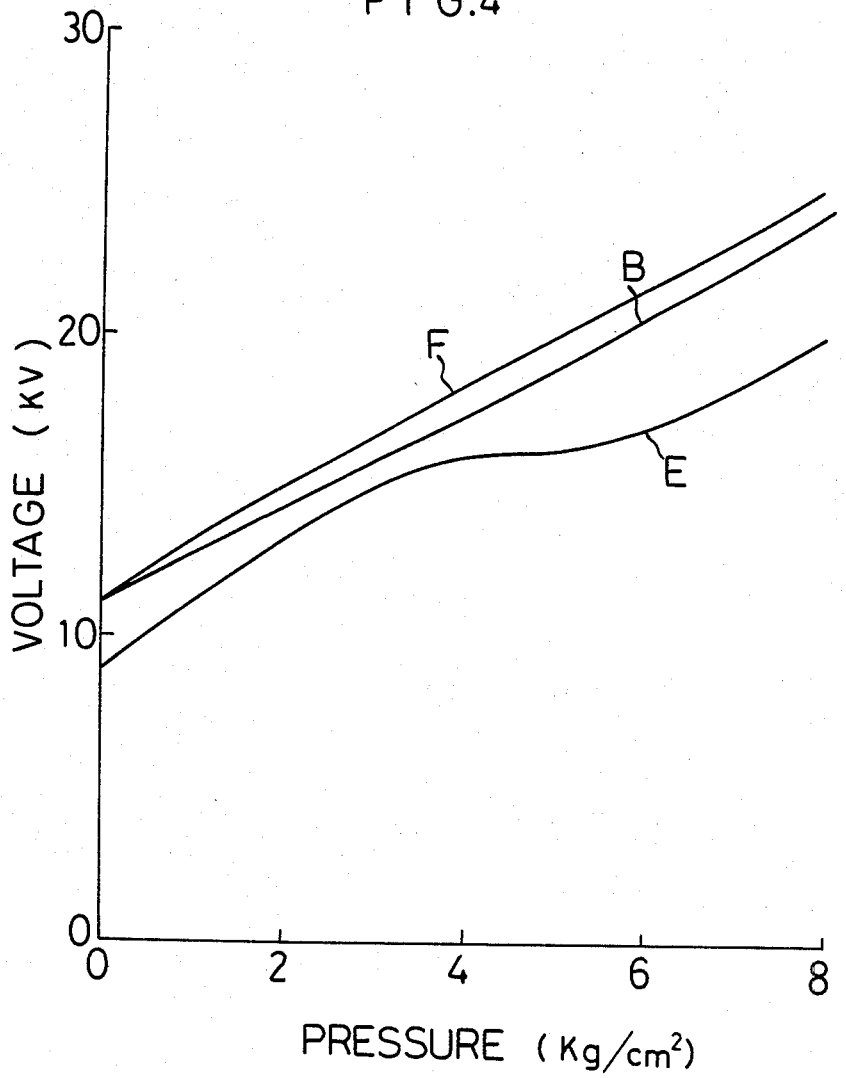

FIG. 4 shows the experimental result of the spark ignition systems provided with two spark gaps. The line E shows the result of the spark ignition system according to the first embodiment of the present invention, which is provided with two spark gaps having a length of 0.3 mm and 0.5 mm, the line B shows the result of the spark ignition system of which all spark gaps have a length of 0.4 mm, and the line F shows the result of the spark ignition system of which spark gap on the high voltage power source side has a length of 0.5 mm and that on the earth side has a length of 0.3 mm.

As is apparent from the experimental result of FIG. 4, necessary voltage of the ignition system of the present invention (line E) is smaller than that of the other ignition systems (lines B and F).

FIG. 5 shows the experimental result of the ignition systems provided with four spark gaps, respectively. The line H shows the result of the ignition system according to the second embodiment of the present invention, of which spark gaps have a length of 0.25 mm, 0.35 mm, 0.45 mm, and 0.55 mm, respectively, the line D shows the result of the ignition system of which all spark gaps have an equal length of 0.4 mm and the line G shows the result of the ignition system wherein spark gaps having a length of 0.55 mm, 0.45 mm, 0.35 mm and 0.25 mm are arranged from the high voltage power source side towards the earth side in this order.

As is apparent from FIG. 5, necessary voltage of the spark ignition system of the present invention (line H) is smaller than that of the spark ignition system of which spark gaps has an equal length (line D). And the necessary voltage of the spark ignition system provided with spark gaps of which length gradually decreases from the high voltage power source side towards the earth side (line G) is much larger than that of the spark ignition system provided with spark gaps of which length is equal.

As described above, the present invention relates to a multi-gap spark ignition system provided with a plurality of spark gaps which are formed in series. And the present invention is characterized in that the length of the spark gaps is gradually increased from the high voltage power source side towards the earth side.

According to the present invention, necessary voltage can be decreased as compared with the conventional spark ignition system of which spark gaps have an equal length to one another.

The multi-gap spark ignition system of the present invention can be applied to the ignition system employing a screw type spark plug provided with two electrodes which are opposed to each other through a predetermined spark gap so as to be electrically insulated from each other.

Having now fully described the invention, it will be apparent to one of ordinary skill in the art that many changes and modifications can be made thereto without departing from the spirit or scope of the invention as set forth herein.

What is claimed is:

1. A multi-gap spark ignition system to be installed in an internal combustion engine for igniting air-fuel mixture introduced therein, comprising:

a plurality of electrodes which are adapted to be installed in the wall defining a combustion chamber of the engine to form at least three spark gaps therebetween exposed to the chamber;

a high voltage power source which supplies an electric current to said plurality of electrodes for generating breakdown in said spark gaps;

said electrodes being composed of a high voltage electrode which is connected to said high voltage power source, an earth electrode which is earthed, and a plurality of intermediate electrodes which are positioned between said high voltage electrode and said earth electrode;

said electrodes projecting into said combustion chamber to form said spark gaps between two projecting ends of adjacent two electrodes with said electrodes being arranged in series through said spark gaps and said projecting ends being in the shape of the Letter L with said ends of adjacent electrodes being opposed;

said electrodes being buried within an insulating plate which is adapted to be interposed between a cylinder block and a cylinder head of the internal combustion engine;

said insulating plate being provided with a central hole to define one portion of the combustion chamber with one end of each electrode projecting into said hole; and the length of said spark gaps gradually increasing from the high voltage power source side towards the earth side.

* * * * *